US005921056A

United States Patent [19]

Weiss et al.

[11] Patent Number: 5,921,056

[45] Date of Patent: Jul. 13, 1999

[54] SIDING CORNER CONNECTOR AND METHOD

[76] Inventors: Thomas C. Weiss; Robert S. Davis, both of 1228 W. Collins, Orange, Calif. 92867

[21] Appl. No.: 08/909,268

[22] Filed: Aug. 11, 1997

[51] Int. Cl.[6] ..... E04C 2/38

[52] U.S. Cl. ..... 52/745.16; 52/656.9; 52/656.7; 52/212

[58] Field of Search ..... 52/656.1, 656.7, 52/656.9, 288.1, 278.1, 475.1, 476, 212, 745.16

[56] References Cited

U.S. PATENT DOCUMENTS

| | | | |
|---|---|---|---|
| 2,821,754 | 2/1958 | Hilson . | |
| 3,206,806 | 9/1965 | Powell . | |
| 3,464,177 | 9/1969 | Amato . | |
| 3,784,043 | 1/1974 | Presnick | 52/656.9 |
| 3,906,699 | 9/1975 | Leddy . | |
| 4,570,406 | 2/1986 | DiFazio | 52/656.9 |
| 4,608,800 | 9/1986 | Fredette . | |
| 4,998,947 | 3/1991 | Dostall et al. . | |
| 4,999,961 | 3/1991 | McNary . | |
| 5,431,211 | 7/1995 | Guillemet | 52/656.9 |
| 5,473,853 | 12/1995 | Guillemet et al. | 52/656.7 |
| 5,485,705 | 1/1996 | Guillemet | 52/656.1 |
| 5,625,992 | 5/1997 | Strick et al. | 52/656.9 |

*Primary Examiner*—Carl D. Friedman
*Assistant Examiner*—Yvonne Horton-Richardson
*Attorney, Agent, or Firm*—John J. Connors; Connors & Assoc.

[57] ABSTRACT

A corner connector for siding retainers having a unitary structure includes a base plate which is adapted to be attached to a wall that is to be covered with strips of siding. The base plate has a generally orthogonal-shaped edge portion formed by first and second members. Each member has a connecting end and a receiving end over which a siding retainer is adapted to slide and each sized to be received snugly within a channel in a siding retainer slid over an individual member. There is a corner section to which the connecting ends of the first and second members are joined so that the first and second members are at an angle of substantially 90°. The corner section has raised segments where each of the connecting ends join the corner section. The raised segments serve as stops which abut an end of a retainer slid over an individual member.

8 Claims, 7 Drawing Sheets

12
52
57
60
50
44
12b
102
51
48
108
53
104
14
14b
106
117
113
115
112
114a
110
114b
112a
114
120
106a
108a
105
122
5
106c
106b
112A
114c
102a
106d
104a
104

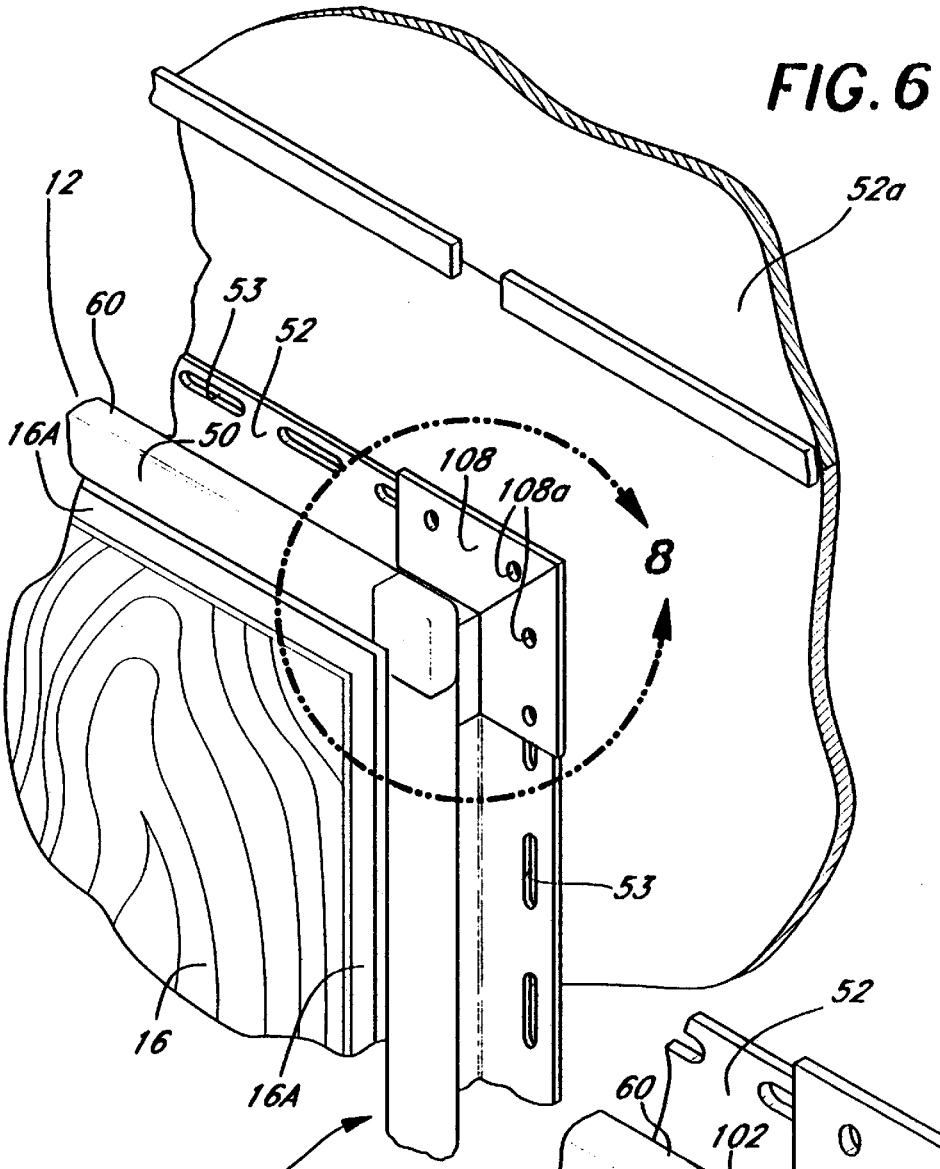
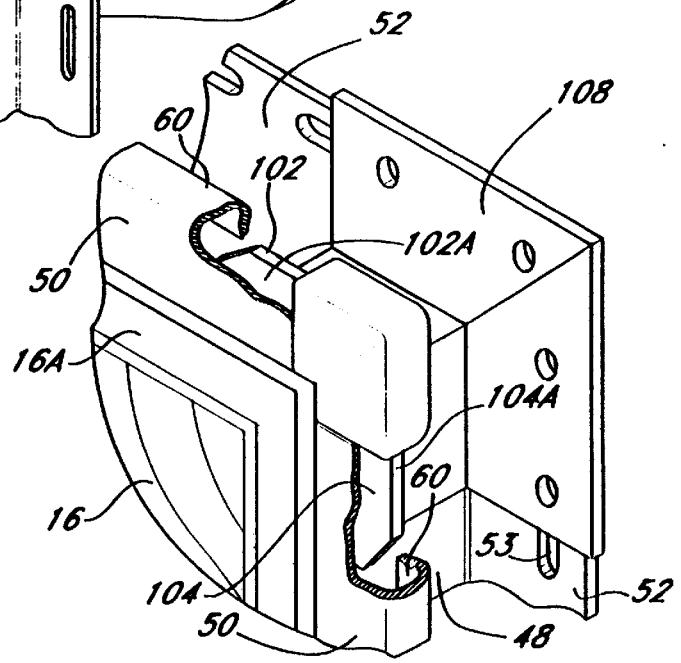
FIG. 8

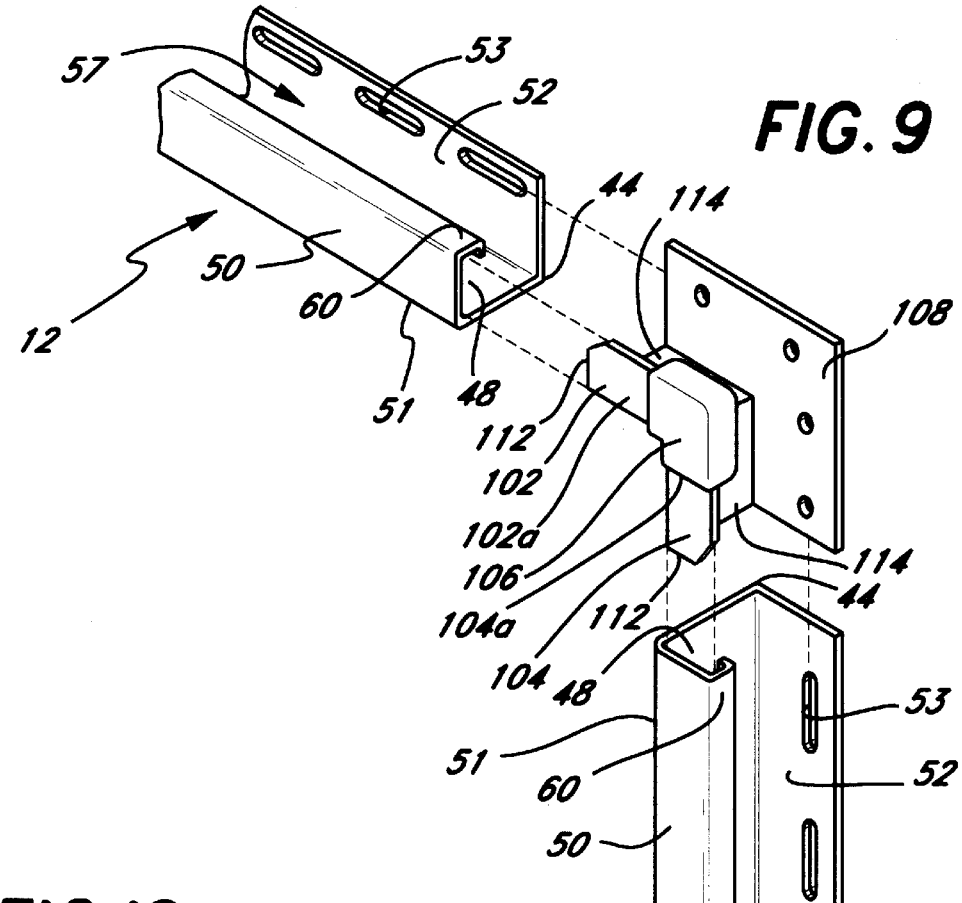
FIG. 9
FIG. 10
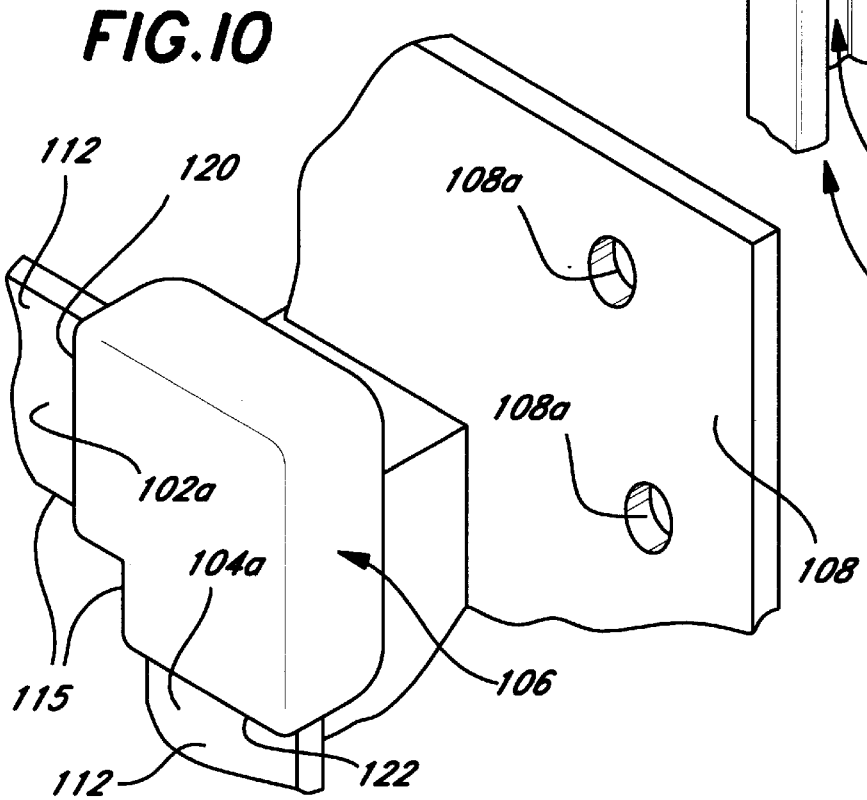

SIDING CORNER CONNECTOR AND METHOD

BACKGROUND OF THE INVENTION

1. Field of the Invention

This invention relates to a corner connector used to hold siding retainers for framing windows, doors, and other right angle structures, and particularly a corner connector which has improved sealing characteristics that prevent, or minimize, water damage problems and avoid debris and unsightly dirt which normally collect on conventional corner connectors.

2. Background Discussion

Use of strips of siding to cover exterior walls of buildings is a common practice. The siding strips may be made of aluminum, steel, vinyl chloride, or other materials. These strips are fastened to an exterior wall in a conventional manner, with the ends of these strips received in siding retainers having a generally J-shaped configuration and are referred to as J-channels. These siding retainers are fastened along the marginal areas of a right angle structure to frame the right angle structure. Where the ends of the retainers meet at a corner of the right angle structure, the ends are mitered. If the miter is not precise, there is a problem with water leakage. Moreover, it is exceedingly time consuming to make such miters, and if such miters are imprecise, they are unsightly. It has been suggested that the miter operation be eliminated by use of a corner connector disclosed in U.S. Pat. No. 4,608,800 by Richard Fredette.

The Fredette corner connector is fastened at the corner of a window, door, or other right angle structure, and a siding retainer is slipped into a channel in a leg in this corner connector. Although the Fredette corner connector is an advance over the conventional practice of mitering the ends of siding retainers because the time consuming mitering operation is eliminated, because the retainer is slipped within a channel in the corner connector, an inadequate seal in many instances is formed, resulting in water leakage when it rains, and dust and other debris collects along the junction between the siding retainer and an edge of the leg of the Fredette corner connector. Water seeping around the retainer and Fredette corner connector, over time, may produce dry rot in the wall that the siding is suppose to protect.

SUMMARY OF THE INVENTION

It is the objective of this invention to provide a corner connector which enables the siding retainers to be attached in a manner which (1) eliminates excessive leakage and consequent damage to the underlying wall structure, and (2) avoids the collection of unsightly dust and debris where the siding retainer and corner connector meet.

This invention has several features, no single one, of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENTS," one will understand how the features of this invention provide its benefits, which include elimination of (1) mitering of the adjoining ends of siding retainers, (2) excessive seepage of water around the corner connector and adjoining siding retainers, and (3) accumulation of dust and debris at the junction of the corner connector and adjoining siding retainers.

The first feature of the corner connector of this invention is that it includes a base plate which is adapted to be attached to a wall that is to be covered with strips of siding. The base plate has a generally orthogonal-shaped edge portion formed by a pair of mounting members over which individual siding retainers are slid.

The second feature is that each member has a connecting end and a receiving end over which a siding retainer is adapted to slide and each member is sized to be received snugly within a channel in a siding retainer slid over an individual mounting member.

The third feature is that the corner connector includes a corner section to which the connecting ends of each mounting member are joined so that the members are at an angle of substantially 90°.

The fourth feature is that the corner section has raised segments where each of the connecting ends of the mounting members join the corner section. The raised segments serve as stops which abut an end of a retainer slid over an individual member.

The fifth feature is that the raised segments of the corner section each have a first portion adjacent to an exterior side of the base plate, a second portion adjacent to an exterior side of the first mounting member, and a third portion adjacent an exterior side of the second mounting member.

The sixth feature is that the corner connector is a unitary structure preferably molded from a polymeric material such as, for example, polyvinyl chloride, nylon, steel, and aluminum.

The seventh feature is that the base plate, first member, second member, and corner section may each have step portions therein. The step portions in the first and second members are aligned with the step portions in the corner section. The step portions in the base plate are parallel to the step portions in the first and second members and in the corner section which overlie the step portions in the base plate.

This invention also includes a method for mounting strips of siding to a wall. This method includes:

(a) providing siding retainers for the strips of siding, (b) providing a corner connector for the siding retainers, said corner connector having a base plate which is adapted to be attached to the wall, the base plate having a generally orthogonal-shaped edge portion formed by a first and second mounting members, each having a connecting end and a receiving end over which a siding retainer is adapted to slide and each sized to be received snugly within a channel in a siding retainer slid over an individual mounting member, and a corner section to which the connecting ends of the first and second members are joined so that the first and second members are at an angle of substantially 90°, the corner section having raised segments where each of the connecting ends join the corner section, the raised segments serving as stops which abut an end of a retainer slid over an individual mounting member, (c) attaching the base plate to the wall, (d) sliding one siding retainer over the first mounting member until an end of this one siding retainer abuts one raised segment, and (e) sliding a second siding retainer over the second member until an end of this second siding retainer abuts another raised segment.

DESCRIPTION OF THE DRAWING

The preferred embodiments of this invention, illustrating all its features, will now be discussed in detail. This embodiment depicts the novel and non-obvious corner connector and method of this invention as shown in the accompanying drawing, which is for illustrative purposes only. This drawing includes the following figures (FIGS.), with like numerals indicating like parts:

FIG. 6 is a perspective view of a second embodiment of this invention showing siding retainers attached to the connector of this invention.

FIG. 8 is an enlarged fragmentary view encircled by the line 8 in FIG. 6.

FIG. 9 is an exploded perspective view of the second embodiment of this invention showing the siding retainers positioned to be slid over the connector of this invention.

FIG. 10 is an enlarged fragmentary view of the corner segment of the corner connector shown in FIG. 9.

DETAILED DESCRIPTION OF THE PREFERRED EMBODIMENTS

Prior Art

Figure 1:
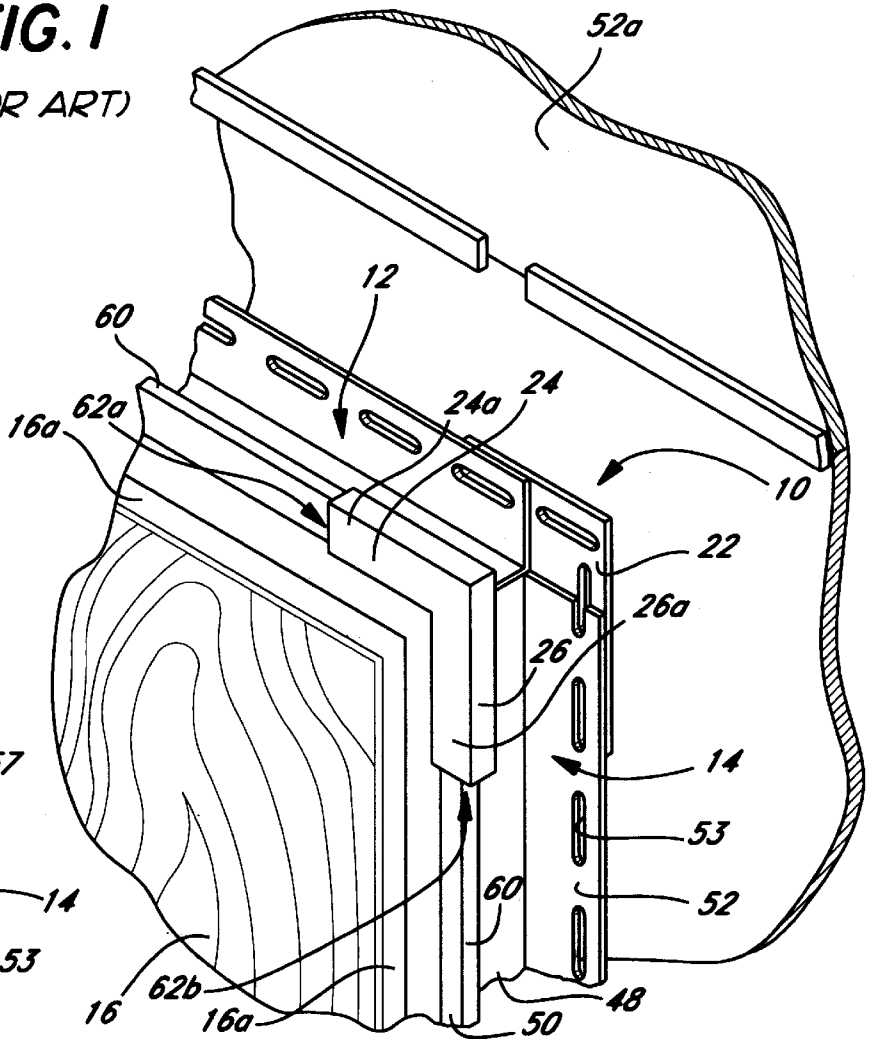
FIG. 1 (PRIOR ART)
FIG. 1 is a perspective view of the Fredette corner connector disclosed in U.S. Pat. No. 4,608,800 attached to a right angle structure.
Figure 2:
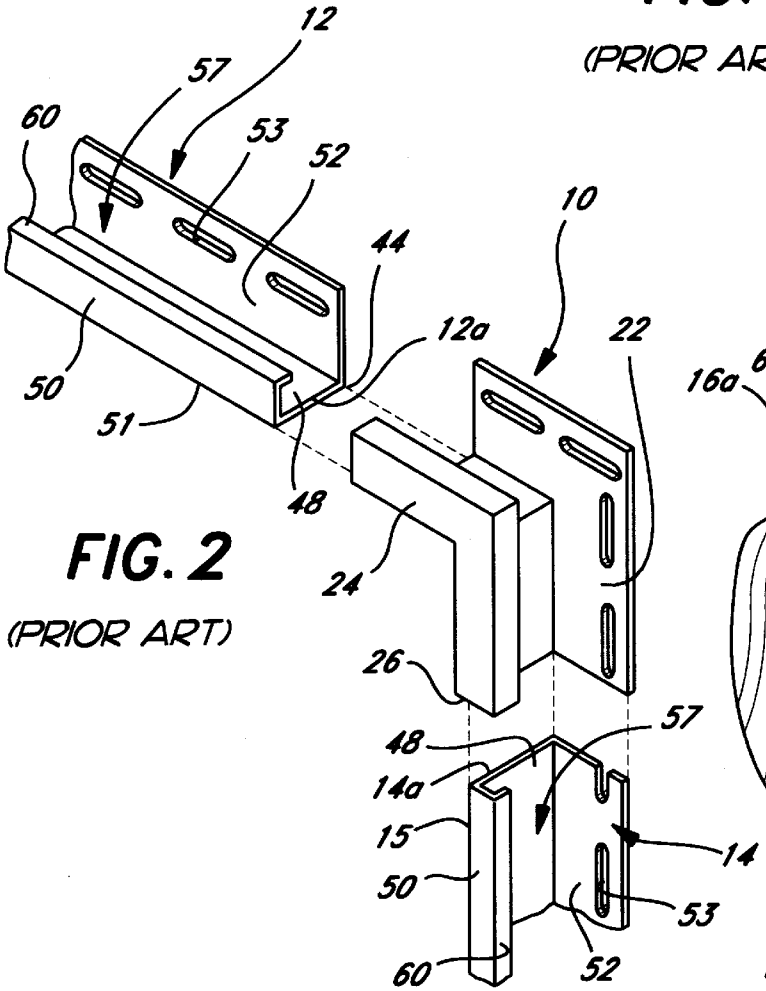
FIG. 2 (PRIOR ART)
FIG. 2 is an exploded perspective view of the Fredette corner connector of U.S. Pat. No. 4,608,800 with siding retainers positioned to be slid into channels in the legs of this connector.

As shown in FIGS. 1 and 2, the Fredette piece or corner connector 10 disclosed in U.S. Pat. No. 4,608,800 includes a pair of legs or channel members 24 and 26 at 90 degrees with respect to each other. These channel members 24 and 26 are attached to a base plate 22 which is secured by nails or other means to a wall 52*a* adjacent a right angle structure such as, for example, a door 16. The Fredette corner connector 10 is fastened at the corner of the door frame 16*a*for the door 16, and one siding retainer 12 is slid into one channel member 24, and another other siding retainer 14 is slid into the other channel member 26.

Each siding retainer 12 and 14 has a mounting plate 52 with slots 53 and a first element or leg 48 and a second element or leg 50. The first leg 48 extends outward from the mounting plate 52 along an edge 44 at an angle of substantially 90°. The second leg 50 is joined along a common junction 51 to the first leg 48 at an angle of substantially 90° and is substantially parallel to the mounting plate 52 and is oriented in a direction to form a generally right angle shaped channel 57. The longitudinal edge of the leg 50 is curled inward to form a U-shaped lip 60. The ends 12*a* and 14*a*, respectively, of the siding retainers 12 and 14 are at a right angle with respect to the longitudinal axes of the legs 48 and 50 and each leg 48 and 50 has a predetermined width, approximately from 0.5 to 1.0 inch, typically ¾ inch and a thickness of about 1/16 inch. The widths of the legs 48 and 50 are less than the widths of the channels in the channel members 24 and 26, allowing the retainers 12 and 14 to be received within these channel members. Thus, as shown in FIG. 1, the end portions 24*a* and 26*a* of the channel members 24 and 26, respectively, overlap the legs 48 and 50 creating steps 62*a* and 62*b*, respectively. This arrangement is defective because a gap forms between the exterior surface of the side of the siding retainers 12 and 14 adjacent a wall or other structure and water seeps into this gap. Consequently, there is significant water leakage around the assembled siding retainers 12 and 14 and corner connector 10. Also, the steps 62*a* and 62*b* collect dirt and debris, resulting in an eyesore.

First Embodiment of the Invention

Figures 3, 4:
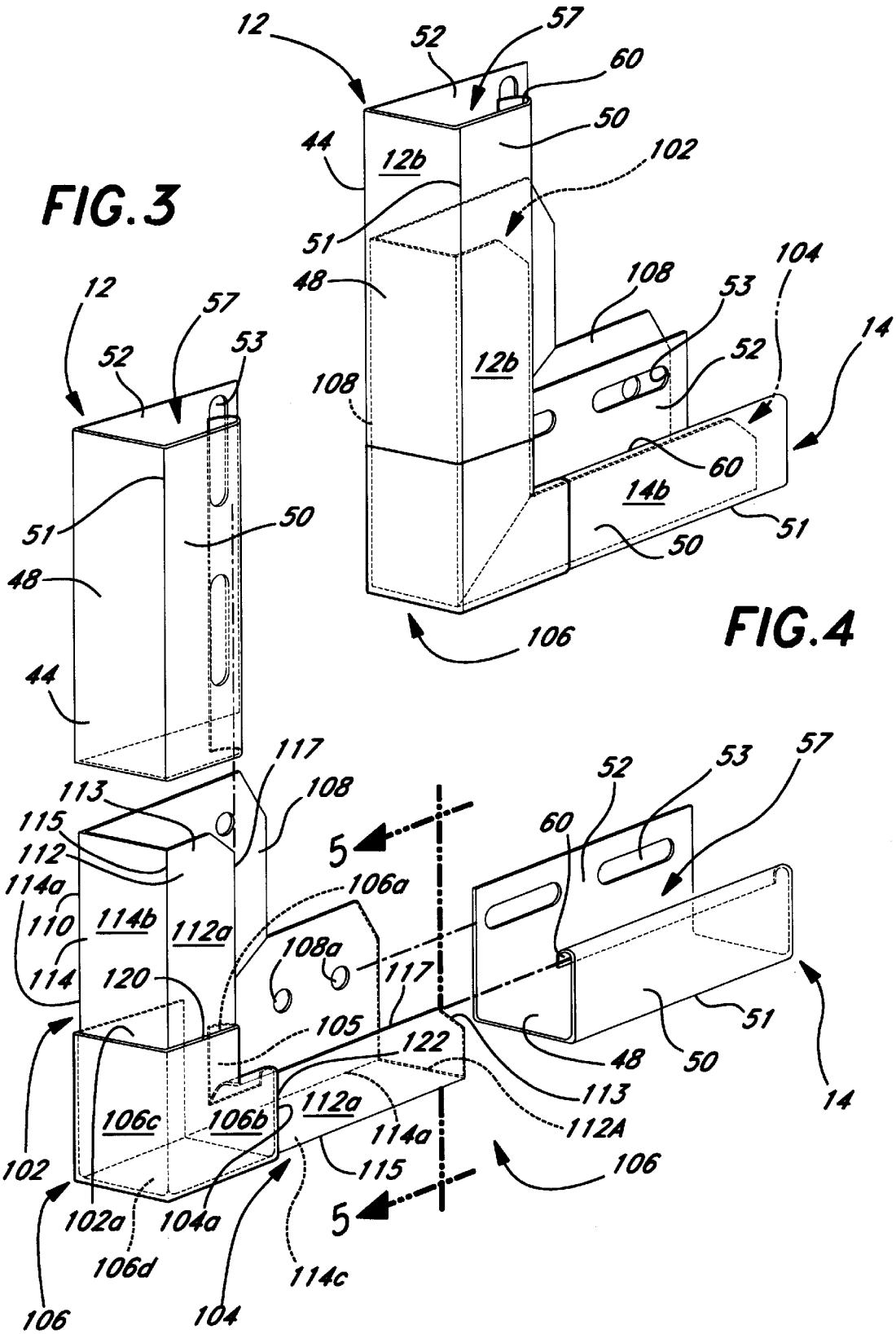
FIG. 3 is an exploded perspective view of the first embodiment of this invention showing siding retainers positioned to be slipped onto the corner connector of this invention.
FIG. 4 is a perspective view similar to that of FIG. 3 showing the assembly of the corner connector of this invention with siding retainers attached to it.
Figure 5:
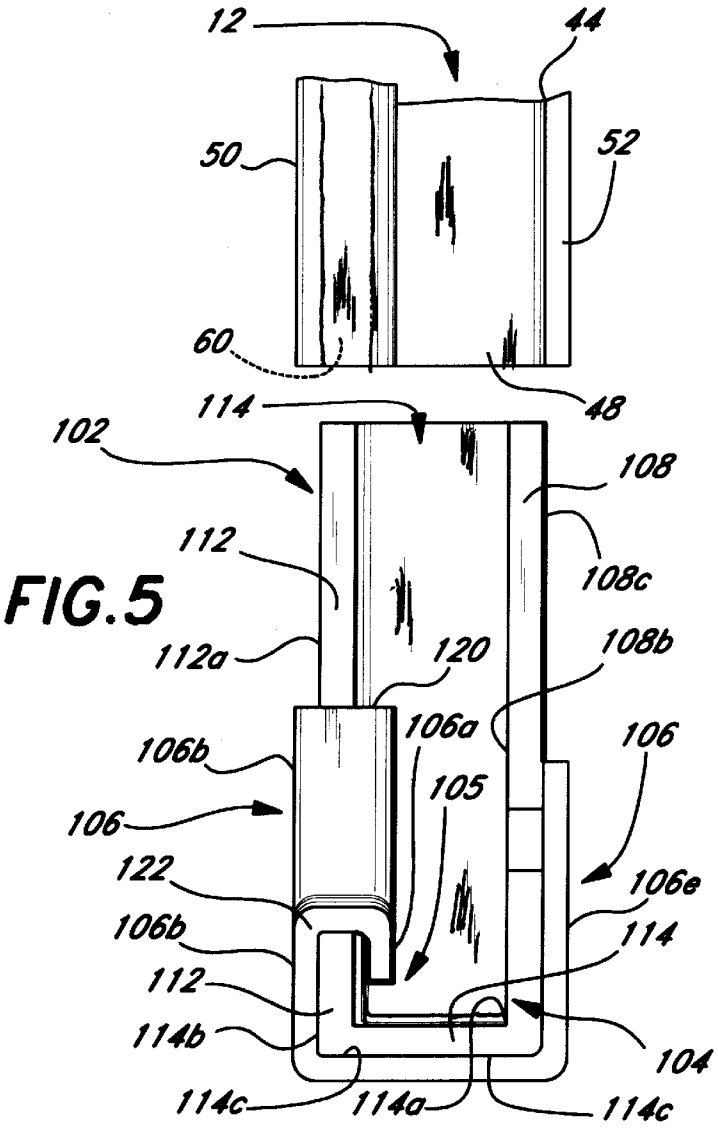
FIG. 5 is an end elevational view taken along line 5—5 of FIG. 3.
Figure 7:
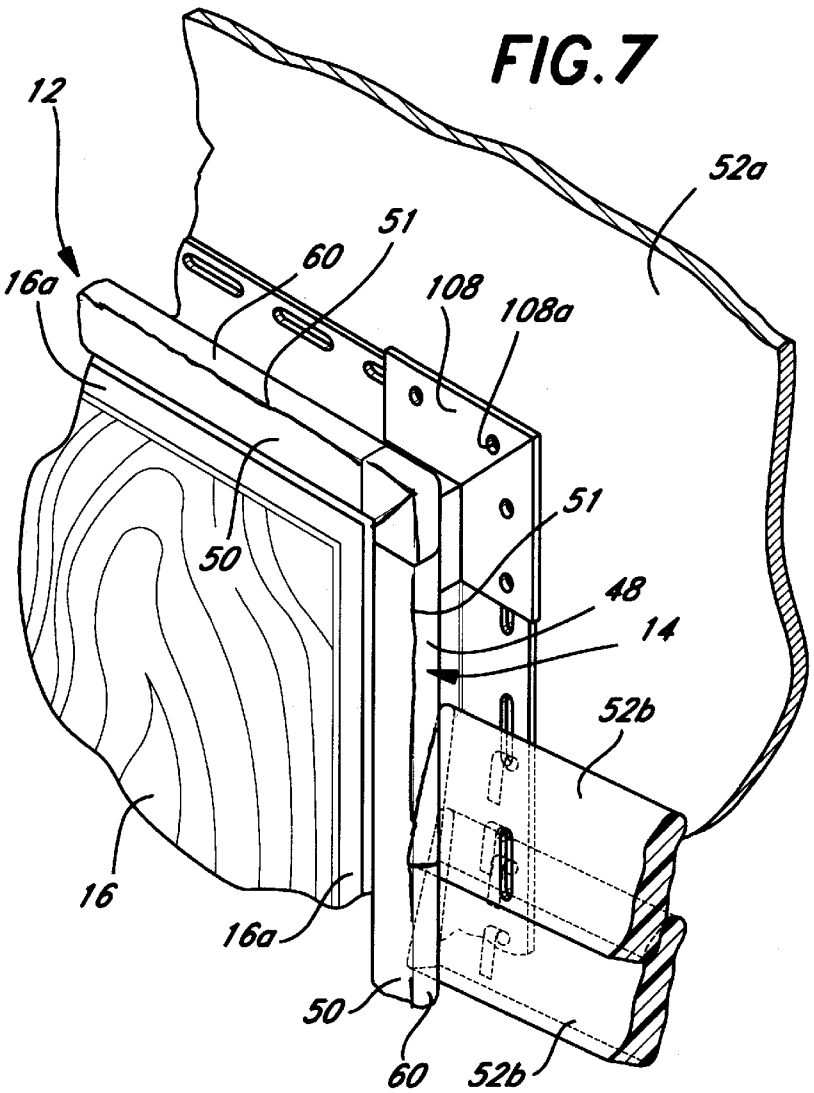
FIG. 7 is a perspective view similar to that of FIG. 6 showing the assembly of siding retainers and the second embodiment of the corner connector of this invention, with siding strips positioned in the siding retainers.

As shown in FIGS. 3 through 5, the first embodiment of this invention is a corner connector 100 designed to be placed at an inside corner of a right angle structure 8. This corner connector preferably is a unitary structure and formed by molding it using conventional injection molding techniques from a polymeric material.such as, for example, polyvinyl chloride, nylon, steel, and aluminum.

The corner connector 100 includes a pair of mounting members 102 and 104 which extend outward from a corner section 106. In contrast to the Fredette corner connector 10, the siding retainers 12 and 14 slide over the exterior of the mounting members 102 and 104 to attach the retainers to the connector 100. The members 102 and 104 each have, respectively, connecting ends 102*a* and 104*a* which join the corner section 106 in a manner to orient the mounting members with respect to each other at an angle of substantially 90°. Each mounting member 102 and 104 has a receiving end 102*b* and 104*b*, respectively, over which the retainers 12 and 14, respectively, slide. The retainers 12 and 14 are aligned, respectively, with the receiving ends receiving ends 102*b* and 104*b* and manually pushed onto the members 102 and 104 to force these members into the channels 57 of the retainers. The members 102 and 104 are sized so that there is a snug fit between the members 102 and 104 and the retainers 12 and 14. Free edges 117 of the planar elements 112 and 114 fit into the U-shaped lip 60 as the retainers are slid over the mounting members 102 and 104.

The corner connector 100 includes a base plate 108 which has a generally L-shaped configuration and a generally orthogonal-shaped edge portion 110. This base plate 108 has holes 108*a* for nails or other types of fasteners to attach the corner connector 100 to the wall 52*a*. Each mounting member 102 and 104 comprises a pair of elongated, planar elements 112 and 114 connected at a common junction 115 at an angle of substantially 90° with respect to each other. The one planar member 114 has an edge 114*a* which is connected to the edge portion 110 of the base plate 108. Preferably, the ends 113 of the planar elements 112 are chamfered. This assist in sliding the retainer 12 and 14, respectively, over the mounting members 102 and 104.

The corner section 106 generally has an orthogonal configuration that has raised segments 120 and 122 where the mounting members 102 and 104 join the corner section. As best illustrated in FIGS. 3 and 5, these raised segments 120 and 122 are the edges the corner section 106. The corner section 106 has multiple surfaces: (1) a substantially L-shaped internal piece 105 that has a substantially flat, L-shaped face surface portion 106*a* adjacent and parallel to an exterior side 108*b* of the base plate 108; (2) a substantially flat, rectangular, face surface portion 106*b* adjacent and parallel to exterior sides 112*a* of the planar elements 112; (3) a substantially flat, rectangular, face surface portion 106*c* adjacent and parallel to the one exterior side 114*b* of the one planar element 114 which is part of the mounting member 102; (4) a substantially flat, rectangular, face surface portion 106*d* adjacent and parallel to the exterior side 114*c* of the planar element 114 which is part of the mounting member 104; and (5) a substantially flat, rectangular, face surface portion 106*e* adjacent and parallel to an interior side 108*c* of the base plate 108.

Because of the configuration of the corner section 106, the planar elements 112 and 114 are consequently offset with respect to the surfaces 106*a* through 106*e*. The heights of the raised segments 120 and 122 are approximately equal to the thickness of the mounting plate 52 and the legs 48 and 50 of the retainers 12 and 14, so that, when the retainers are attached to the corner connector 110 as illustrated in FIG. 4, the exterior surfaces 12*b* and 14*b* (FIG. 4) of the retainers are essentially flush with the surfaces 106*a* through 106*e* of the corner section 106. The one planar member 112 has a width slightly less than the width of the one leg 50 of the retainer, and the other planar element 114 has a width slightly less than the width of the other leg 48 of the retainer element. Consequently, when the retainers 12 and 14 is slid, respectively, over the members 102 and 104, (1) the mounting plates 52 for the retainers slide underneath the base plate 108 of the corner connector 100, and (2) the one leg 50 of each retainer 12 and 14 slides over the planar element 112, and the other leg 48 of each retainer slides over the planar element 114.

The siding strips 52*b* are positioned within the retainers 12 and 14 so that the ends of individual siding strips fit in the channels 57 provided by the siding retainers. With the retainers 12 and 14 on the exterior of the mounting members 102 and 104 an essentially continuous barrier is provided by this assembly of corner connector 100 and attached retainers 12 and 14. Consequentially, there is a much better seal between the siding retainers 12 and 14 and the exterior surfaces of the siding strips 52*b*, avoiding or minimizing leakage. Also, since the exterior surfaces of the siding retainers 12 and 14 are flush with the corner section 106, dirt and debris does not tend to collect at this junction. Instead the ends of the siding retainer abut the raised segments 120 and 122.

Second Embodiment of the Invention

FIGS. 6 through 10 depict an alternate embodiment of this invention similar to that shown in FIGS. 3 through 5, except the mounting members 102 and 104 are oriented so that a corner connector 200 is provided that is placed at an outside corner of a right angle structure. Except for this change in orientation of the mounting members 102 and 104, the corner connector 200 is essentially identical to that of the corner connector 100.

Third Embodiment of the Invention

Figure 11:
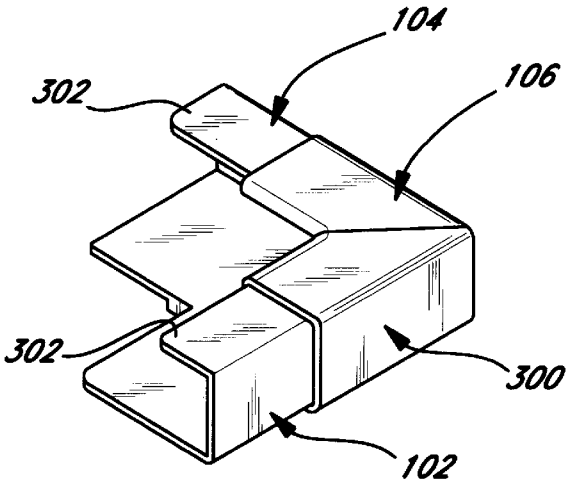
FIG. 11 is a perspective rear view of a third embodiment of this invention similar to the first embodiment shown in FIG. 3.
Figure 12:
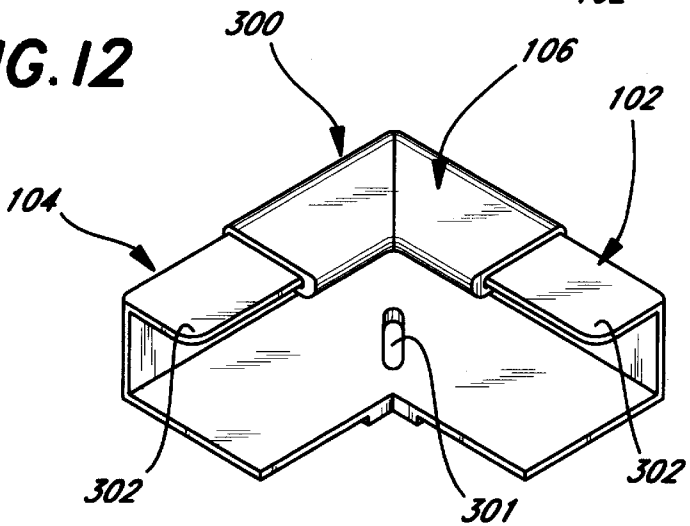
FIG. 12 is a perspective front view of a third embodiment of this invention shown in FIG. 11.
Figure 13:
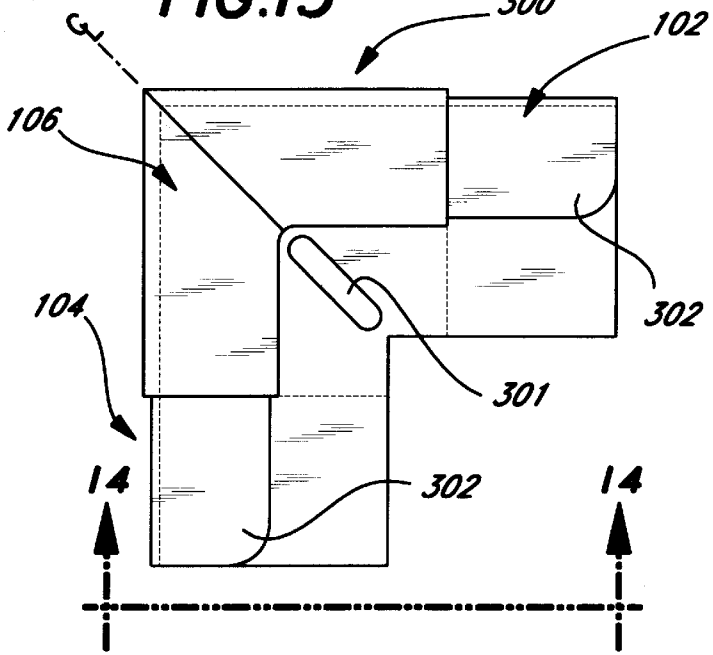
FIG. 13 is a plan view of the third embodiment of this invention shown in FIGS. 11 and 12.
Figure 14:
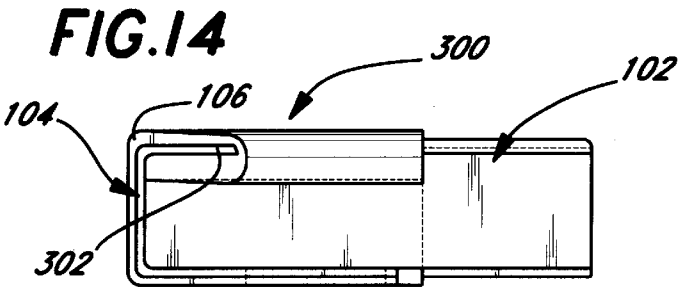
FIG. 14 is an end elevational view of the third embodiment of this invention taken along line 14—14 of FIG. 13.

As shown in FIGS. 11 through 13, the third embodiment of this invention is a corner connector 300 similar to the corner connector 100. The corner connector 300 includes a pair of mounting members 102 and 104 which extend outward from a corner section 106. The main differences between the first and third embodiments is that an elongated slot 301 provides access for mounting the connector 300 to a wall or the like, and the corners 302 are rounded.

Forth Embodiment of the Invention

Figures 15, 16, 17:
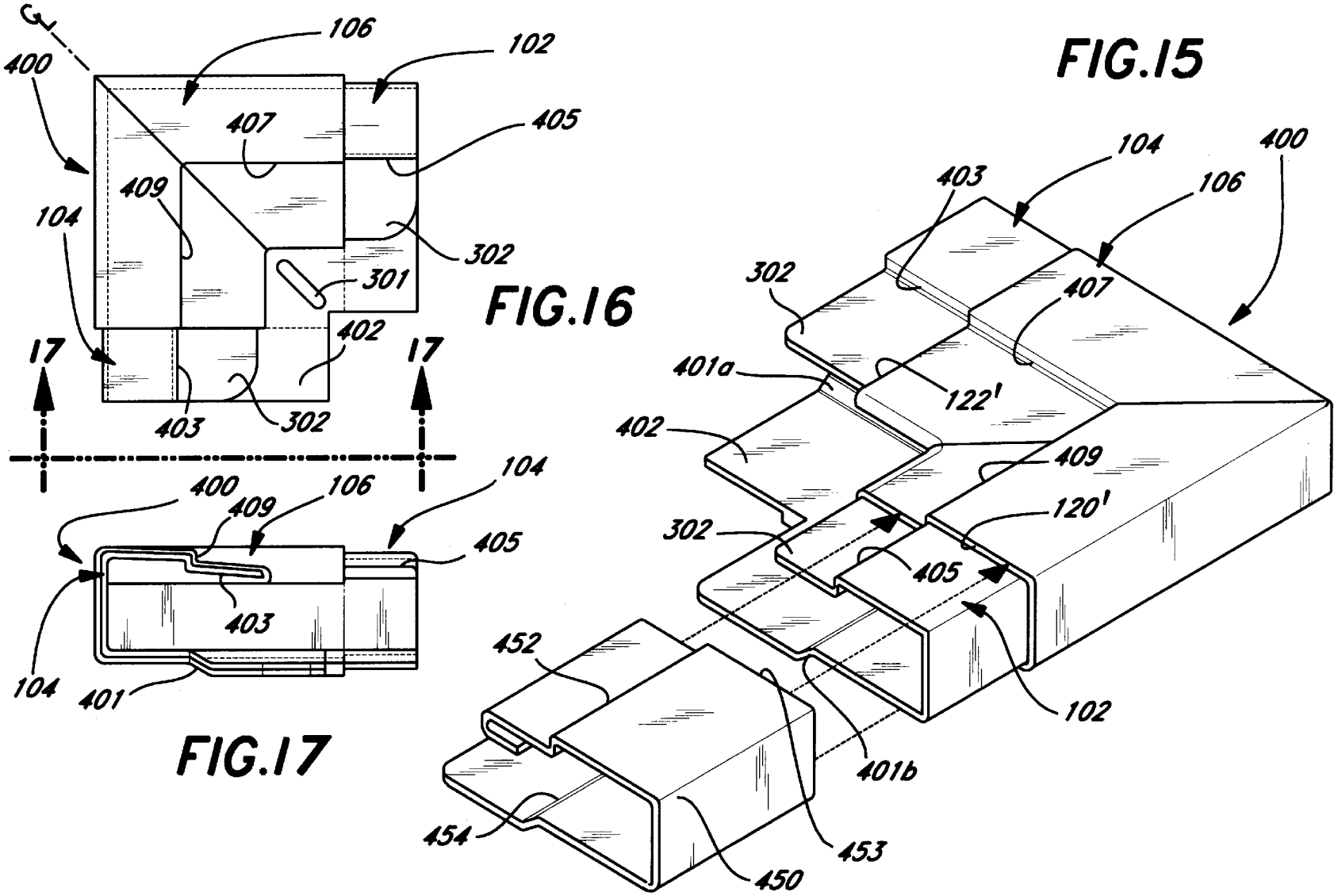
FIG. 15 is a perspective rear view of a forth embodiment of this invention similar to the third embodiment shown in FIG. 11, but having step portions therein.
FIG. 16 is a plan view of the forth embodiment of this invention shown in FIG. 15.
FIG. 17 is an end elevational view of the forth embodiment of this invention taken along line 17—17 of FIG. 16.

As shown in FIGS. 15 through 17, the forth embodiment of this invention is a corner connector 400 similar to the corner connector 300. The corner connector 400 includes step portions 401*a* and 401*b* in the base plate 402, a step portion 403 in the mounting member 104, a step portion 405 in the mounting member 102, and step portions 407 and 409 in the top surface of the corner section 106. The step portions 401*a* and 401*b* in the base plate 402 intersect at their inner ends (not shown) to form a right angle with respect to each other, and the step portions 407 and 409 intersect at their inner ends to form a right angle with respect to each other. Raised segments 120' and 122' are formed which differ from the raised segments 120 and 122 of the first embodiment in that there are steps therein.

A pair of siding retainers 450 (only one shown) are used with the corner connector 400. Each siding retainer 450 employs steps 452 and 454 which correspond to the steps in the corner connector 400. In other words, the siding retainers 450 each have a cross-sectional configuration essentially the same as the cross-sectional configuration of the mounting members 102 and 104 in the corner connector 400, but slightly larger so that the siding retainers 450 easily slid over the mounting members 102 and 104 of the corner connector 400. For example, the sliding retainer 450 has the steps 452 and 454. These steps 452 and 454 engage the steps 405 and 401(*b*), respectively, as the siding retainer 450 slides over the mounting member 102. The inside edge 453 of the siding retainer 450 abuts the raised segment 120' when this inside edge is pushed against this raised segment.

Scope of the Invention

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention.

We claim:

1. A method for mounting strips of siding to a wall including (a) providing siding retainers for the strips of siding, (b) providing a corner connector for the siding retainers, said corner connector having a base plate which is adapted to be attached to the wall, said base plate having a generally orthogonal-shaped edge portion formed by a first and second members each having a connecting end and a receiving end over which a siding retainer is adapted to slide and each sized to be received snugly within a channel in a siding retainer slid over an individual member, and a corner section to which the connecting ends of the first and second members are joined so that the first and second members are at an angle of substantially 90°, said corner section having raised segments where each of said connecting ends join the corner section, said raised segments serving as stops which abut an end of a retainer slid over an individual member, (c) attaching the base plate to the wall, (d) sliding one siding retainer over the first member until an end of said one siding retainer abuts one raised segment, and (e) sliding a second siding retainer over the second member until an end of said second siding retainer abuts another raised segment.

2. The method of claim 1 where the corner connector is formed as a unitary structure molded from a polymeric material.

3. The method of claim 1 where the corner connector is formed from polyvinyl chloride, nylon, steel, or aluminum.

4. The method of claim 1 where the raised segments are edges of the corner section and said corner section has a first surface portion adjacent an exterior side of the base plate, a second surface portion adjacent an exterior side of the first member, a third surface portion adjacent an exterior side of the second member, and a fourth surface portion adjacent an interior side of the base plate.

5. The method of claim 1 where the siding retainers each have a mounting plate, a first leg extending outward from the mounting plate at an angle of substantially 90°, a second leg joined along a common junction to the first leg at an angle of substantially 90° and substantially parallel to the mounting plate and oriented in a direction to form a generally right angle shaped channel, each leg having a predetermined width.

6. The method of claim 5 where the first member comprises a first pair of elongated, planar elements joined along a common junction at an angle of substantially 90°, one of said elongated elements of said first pair having an edge which is joined to the base plate at an angle of substantially 90° and the other of said elongated elements of said first pair being substantially parallel to the base plate and extending inward toward the base plate, said one of said elongated elements of the first pair having a width which is slightly less than the width of the first leg of the one retainer and the other of said elongated elements of the first pair having a width which is slightly less than the width of the second leg of the one retainer, so that, when the one retainer is slid over the first member, the first member is received snugly within the channel of the one retainer, the second member comprises a second pair of elongated, planar elements joined along a common junction at an angle of substantially 90°, one of said elongated elements of said second pair having an edge which is joined to the base plate at an angle of substantially 90° and the other of said elongated elements of said second pair being substantially parallel to the base plate and extending inward toward the base plate, said one of said elongated elements of the second pair having a width which is slightly less than the width of the first leg of the second retainer and the other of said elongated elements of the second pair having a width which is slightly less than the width of the second leg of the second retainer, so that, when the second retainer is slid over the second member, the second member is received snugly within the channel of the second retainer, said first and second members each having a connecting end and a receiving end, said receiving end of the first member being disposed within the channel of the one retainer and said receiving end of the second member being disposed within the channel of the second retainer.

7. The method of claim 6 where the first and second raised segments each have a predetermined height and the legs of the one retainer and second retainer each have a thickness which is substantially equal to said height.

8. The method of claim 6 where each second leg of the one retainer and second retainer has a U-shaped lip into which a free edge of the other of the elongated elements is received.

* * * * *